United States Patent [19]

Baillie

[11] 4,375,223

[45] Mar. 1, 1983

[54] DIAL OPERATED PRESSURE REGULATOR

[75] Inventor: Robert J. Baillie, Gladesville, Australia

[73] Assignee: Power Automotive Equipment Pty. Ltd., Australia

[21] Appl. No.: 202,132

[22] Filed: Oct. 30, 1980

[30] Foreign Application Priority Data

Nov. 5, 1979 [AU] Australia ..... PE1202

[51] Int. Cl.[3] ..... F15B 13/042

[52] U.S. Cl. ..... 137/116.5; 91/457; 91/461; 91/464; 91/465; 137/596.1; 137/627.5; 137/636.1

[58] Field of Search ..... 91/457, 461, 464, 465; 137/116.5, 596.1, 627.5, 636.1

[56] References Cited

U.S. PATENT DOCUMENTS

| | | | |
|---|---|---|---|
| 2,075,917 | 4/1937 | Vorech | 137/636.1 |
| 2,393,076 | 1/1946 | Van der Werf | 137/596.1 |
| 2,401,680 | 6/1946 | Eaton | 91/464 X |
| 2,511,384 | 6/1950 | Trevaskis | 137/636.1 |
| 2,934,091 | 4/1960 | Chapou | 137/636.1 X |
| 3,099,461 | 7/1963 | Stelzer | 137/627.5 X |
| 3,128,635 | 4/1964 | Doolittle | 137/627.5 X |
| 3,805,674 | 4/1974 | Sebesta | 137/636.1 X |
| 4,134,418 | 1/1979 | Woodcock | 137/116.5 |

*Primary Examiner*—Robert G. Nilson

*Attorney, Agent, or Firm*—Henry M. Bissell

[57] ABSTRACT

A dial operated air pressure regulator produces forward, hold and reverse signals in an air operated control circuit which creates corresponding conditions in a hydraulic circuit. The regulator has a pair of spring loaded valves which slide axially in a pair of valve cylinders which in turn control the air flow in the circuit. The valves are depressed by face cams moulded into the dial; rotation of the dial in one direction causes one cam to operate one valve and produces a forward signal; rotation in the opposite direction causes the other cam to operate the associated valve to create the reverse signal; when neither valve operates, the hold signal results.

4 Claims, 5 Drawing Figures

DIAL OPERATED PRESSURE REGULATOR

BACKGROUND OF THE INVENTION

This invention concerns dial operated pressure regulators for the manual control of pneumatic and hydraulic circuits.

The device will be described in relation to a truck with a dump body but the device is clearly utilisable for other applications where manual control of simple circuitry is advantageous, for example, farm machinery, machine shop practice and the like.

DESCRIPTION OF THE PRIOR ART

Where two or more separate functions are actuated by hydraulic pressure for example moving the dump body of the truck by raising and lowering and arresting the dump body in a fully or partially raised position, a pneumatic servo mechanism is provided with two separate controls, one for each function. In practice, the dumping operation may put the vehicle in a temporarily unstable position, that is where the centre of gravity of the truck is unusually elevated for example, where part of a load lodges in the foremost and therefore the highest part of the dump body. Pneumatic servos provide only on/off conditions so controlled descent is not possible and the arrested momentum of the descending load can be large enough to distort a truck chassis. The truck operator uses two separate controls and matches the motor throttle to the hydraulic pump output which is required. It is an objective of the present invention to provide a simplified manual control for this and similar situations.

SUMMARY OF THE INVENTION

The object of the invention is accomplished by a dial operated fluid pressure regulator for producing forward, hold and reverse signals in a fluid control circuit which in turn creates a forward, hold and reverse conditions in a hydraulic circuit, said regulator comprising a body, a pair of mutually adjacent parallel valve cylinders in the body, a fluid inlet and fluid outlet for each valve cylinder connectable to said fluid control circuit, a valve slidably located in each cylinder to influence the passage of fluid in the control circuit, the axial movement of one valve causing the forward signal in the circuit, the axial movement of the other valve causing the reverse signal in the circuit, and the movement of neither valve causing the hold signal in the circuit, and a dial mounted on the body, provided with a first face cam which causes axial movement of one valve when the dial is rotated through a first sector, a second face cam which causes axial movement of the other valve when the dial is rotated through a second sector, said cams being arranged to provide a null position reached by rotation of the dial between the two face cams.

The valve causing the forward signal in the circuit may be an on/off valve and the valve causing the reverse signal in the circuit may be a fluid pressure regulating valve. A removable cover may be fixed to the body defining between the latter and the cover a circular track surrounding the cylinders; the dial may be a control knob provided with a peripheral flange which rides in the track and lies imprisoned between the cover and the body and the control knob is provided with a central circular cavity facing the pair of cylinders, said face cams projecting within the cavity and lying in the path of said valves. Both cams may lie in the same sector of the circular cavity but at different distances from the cavity centre and the valves may lie asymmetrically disposed about the cavity centre on a common diameter of the cavity. A ball may be located in each of the pair of the cylinders and disposed between the valve and the respective cam. In the case of the on/off valve the ball abuts the valve but in the case of the air pressure regulator the ball is spaced from the valve by a spring in order to allow the regulator to vent to atmosphere.

The invention also provides a combination of a dial operated fluid pressure regulator as defined above, a fluid control circuit containing a source of pressurised fluid, a hydraulic circuit containing a source of pressurised liquid, a single acting hydraulic ram and a three-position spool valve wherein the three positions of the spool valve cause ram extension, ram immobility and ram return respectively and are controlled by the forward, hold and reverse signals of the control circuit whereby rotation of the dial permits the selection of any of the three conditions in the hydraulic circuit.

DESCRIPTION OF THE PREFERRED EMBODIMENT

DUMPER MECHANISM

Figure 1:
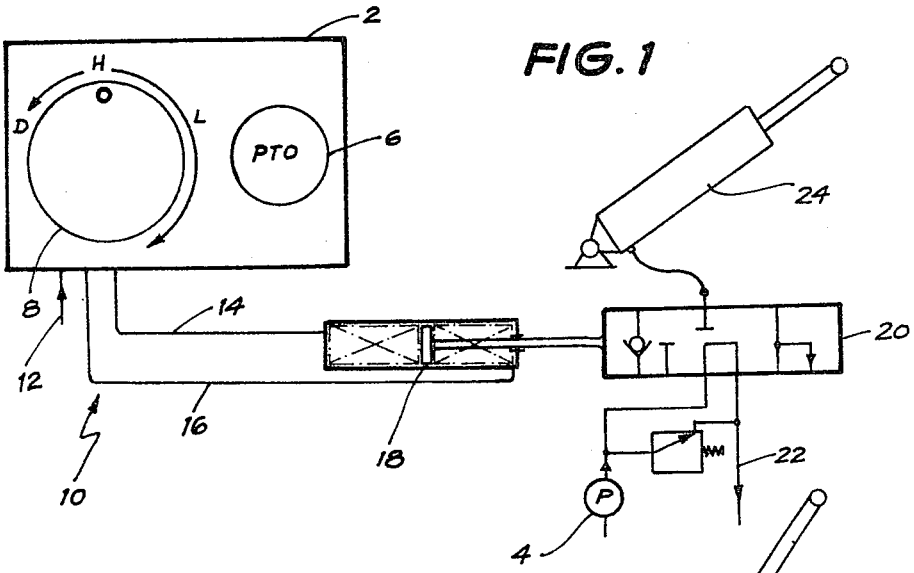
FIG. 1 is a diagrammatic layout of the regulator together with a control circuit and hydraulic circuit with which it is used in the HOLD position.

Referring now to FIG. 1, the regulator 2 is bolted to the dashboard of a dump truck. The truck gearbox has a power take off which drives the pump 4 and the power take off is switched in and out by a standard separate control knob 6 marked PTO mounted on the regulator 2. The regulator 2 has a control knob 8 which has a HOLD position marked H, a DUMP position marked D and a LOWER position marked L which extends over a substantial arc because the regulator affords control of the speed of descent, the further the rotation of the knob, the greater the rate of descent.

Figure 2:
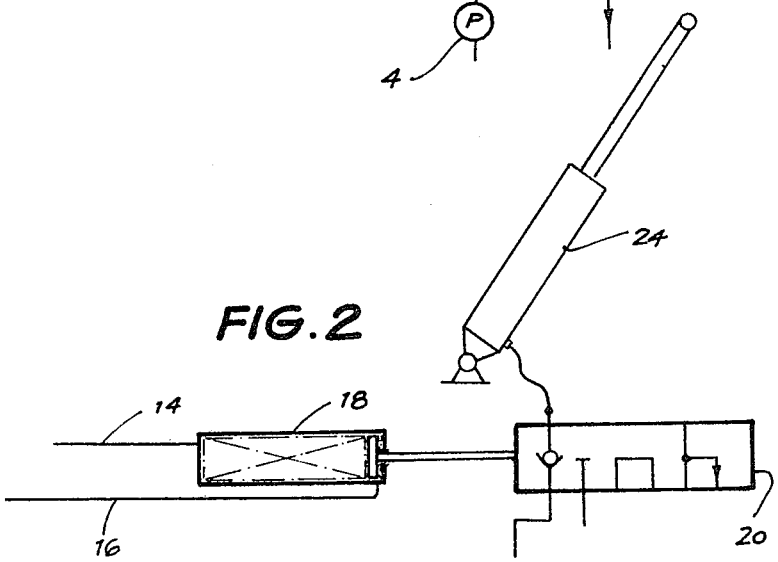
FIG. 2 shows part of the hydraulic circuit of FIG. 1 in the DUMP position.

A pneumatic control circuit 10 includes an air supply conduit 12 and conduits 14, 16 supplying a double-acting, spring centred selector ram 18 the purpose of which is to select the appropriate position for a three-position spool valve 20 which slides laterally to left and right of the centre HOLD position shown in FIG. 1. The spool valve 20 is part of a hydraulic circuit 22 which includes a single acting hoist ram 24 which tips the truck body. In the HOLD position the pump output is returned to the reservoir (not shown) and the ram 24 is isolated. In FIG. 2 the selector ram 18 has received a forward signal from the regulator 2 via knob 9 and has moved the spool valve 20 to the right to connect the tipper ram 24 with a pump output.

Figure 3:
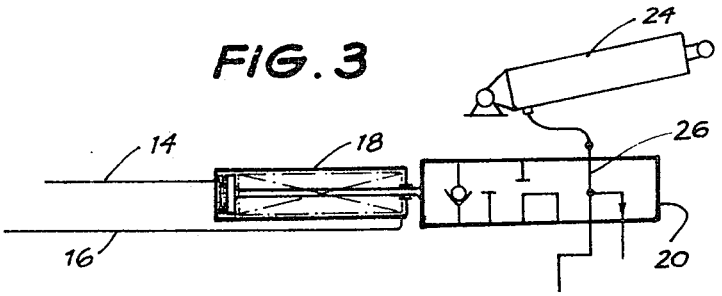
FIG. 3 shows part of the hydraulic circuit of FIG. 1 in the LOWER position.

In FIG. 3 a selector ram 18 has received a reverse signal from the regulator 2 via knob 8 and has moved the spool valve 20 to the left to connect the hoist ram 24 to the reservoir. The spool valve 20 has a axial metering slot (not shown) milled in port 26 such that movement to the reverse position produces a small return flow from the tipper ram 24 which increases as more of the slot is brought in to register. This fast or slow emptying facility is entirely controlled by the air regulator to be described in relation to FIGS. 4 and 5.

REGULATOR

Figure 4:
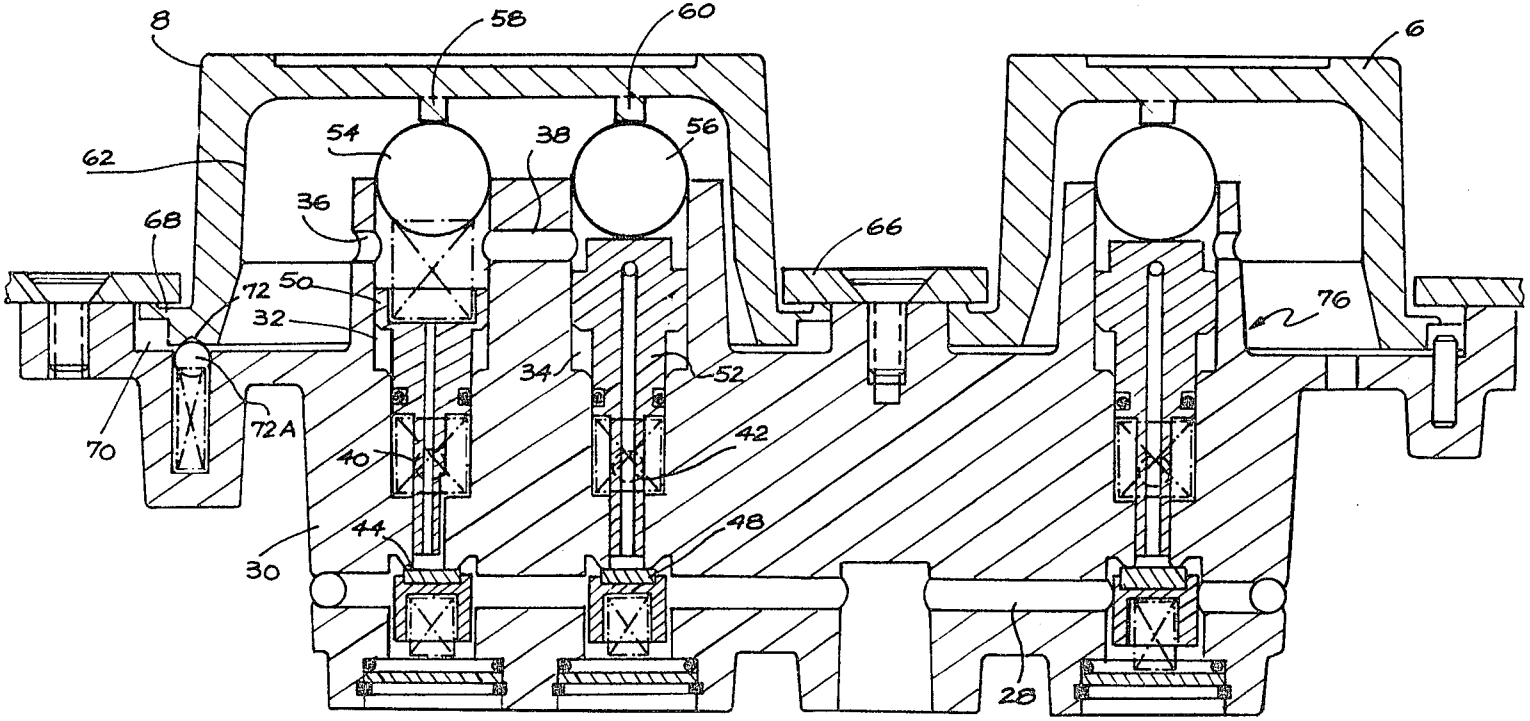
FIG. 4 is a section of the regulator.
Figure 5:
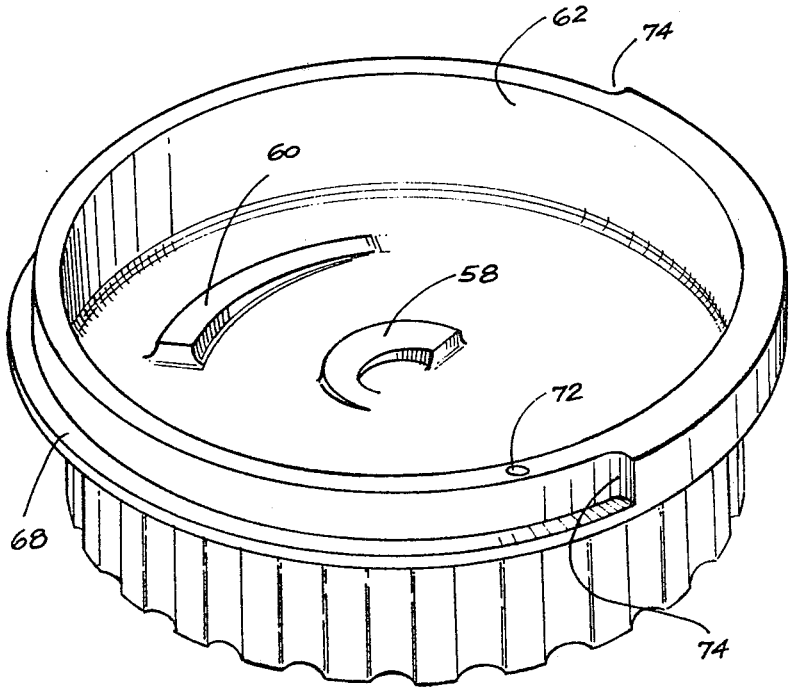
FIG. 5 is a perspective view of the dial.

Referring now to FIGS. 4 and 5, the supply conduit 12 supplies gallery 28 with low pressure air. The regulator body has a pair of counterbored cylinders 32, 34 each vented to atmosphere by ports 36, 38. Ports 40 and 42 connect with conduits 14 and 16 respectively, spring loaded seals 44, 48 occlude the entrances to the cylinders. Spring loaded valves 50, 52 are biased toward the control knob 8 and urge interposed steel balls 54, 56 against cams 58, 60 which are moulded into the cavity 62 of the control knob 8. The latter has a peripheral flange 68 which engages a circular track provided by a bolt on metal cover 66. Cam 60 is quick lift because valve 52 merely acts as an on/off valve giving in effect either no signal or a forward signal. Cam 58 is a slow lift cam because valve 50 is a standard air pressure regulator.

The peripheral flange 68 rides in the circular track 70. Dimple 72 is engaged by detent 72A. Flange stops 74 co-operate with a pin (not shown) projecting into the track.

The valve assembly 76 is also supplied with low pressure air and controlled by knob 6 which merely switches drive to the power take off for driving the hydraulic pump and is subsidiary to the invention.

The regulator works as follows. In the condition shown in FIGS. 1 and 4 the pneumatic control circuit is in balance. Both seals 44, 48 are closed. Rotation of knob 8 to DUMP depresses valve 52, the clearance between the valve and the seal is taken up and the seal 48 opens. The spool valve moves from the HOLD position of FIG. 1 to the position shown in FIG. 2 and air from the exhaust end of ram 18 vents through conduit 16, port 40 and port 36. Return of the knob to HOLD allows the spring centered ram 18 to return to the central HOLD or null position taking the spool valve with it because once more the conduits allow equalisation of pressure through ports 40, 42 through the valve centres and finally to atmosphere through ports 36, 38.

When the knob is rotated to LOWER, cam 58 gradually depresses valve 50, the clearance between the valve and the associated seal 44 disappears and the port 40 directs air through conduit 16 to draw the spool valve to the position shown in FIG. 3. The hoist ram is directly connected to the reservoir and by judicious rotation of the knob an air pressure can be found which moves the spool valve to bring the slot into register with discharge port of the valve. Rapid equalisation of pressure is possible in the ram 18 because one valve of the pair is always vented to atmosphere.

The advantages of the above embodiment are a clearly defined HOLD position which extends for a substantial arc of rotation before the LOWER function is initiated. It affords sensitive control. Rapid movement from any position to HOLD increases safety. A single dial or knob rotating clockwise or anti-clockwise, either side of HOLD, is of the utmost simplicity.

I claim:

1. A dial operated fluid pressure regulator for producing forward, hold and reverse signals in a fluid control circuit which in turn creates (a) forward, hold, and reverse conditions in a hydraulic circuit, said regulator comprising:

a body, a pair of mutually adjacent parallel valve cylinders in the body, a fluid inlet and fluid outlet for each valve cylinder connectable to said fluid control circuit, a valve slidably located in each cylinder to influence the passage of fluid in the control circuit, the axial movement of one valve causing the forward signal in the circuit, the axial movement of the other valve causing the reverse signal in the circuit, and the movement of neither valve causing the hold signal in the circuit, wherein said one valve is an on/off valve and said other valve is a fluid pressure regulating valve, and a dial mounted on the body, provided with a first face cam which causes axial movement of said one valve when the dial is rotated through a first sector and a second face cam which causes axial movement of the other valve when the dial is rotated through a second sector, said cams being arranged to provide a null position reached by rotation of the dial between the two face cams.

2. A dial operated fluid pressure regulator as claimed in claim 1 wherein a removable cover is fixed to the body defining, between the latter and the cover, a circular track surrounding the cylinders; the dial is a control knob provided with a peripheral flange which rides in the track and lies imprisoned between the cover and the body and the control knob is provided with a central circular cavity facing the pair of cylinders, said face cams projecting within the cavity and lying in the path of said valves.

3. A dial operated fluid pressure regulator as claimed in claim 2 wherein both cams lie in the same sector of the circular cavity but at different distances from the cavity centre and the valves lie asymmetrically disposed about the cavity centre on a common diameter of the cavity.

4. A dial operated fluid pressure regulator as claimed in claim 1 where a ball is located in each of the pair of cylinders and disposed between the valve and the respective cam.

* * * * *